United States Patent [19]

Schmidt

[11] 3,968,948

[45] July 13, 1976

[54] KITE ACCESSORY TOY

[76] Inventor: Willard C. Schmidt, 713 W. 7th St., Willmar, Minn. 56201

[22] Filed: June 4, 1975

[21] Appl. No.: 583,596

[52] U.S. Cl. ..... 244/155 R
[51] Int. Cl.[2] ..... B64C 31/06
[58] Field of Search ..... 244/155 R; D34/15 AF

[56] References Cited

UNITED STATES PATENTS

| | | | |
|---|---|---|---|
| 1,304,139 | 5/1919 | Young | 244/155 R X |
| 2,473,213 | 6/1949 | Nissen | 244/155 R |
| 2,833,497 | 5/1958 | Young | 244/155 R |
| 3,596,857 | 8/1973 | Battles | 244/155 R |
| 3,752,424 | 8/1973 | Battles | 244/155 R |

*Primary Examiner*—Trygve M. Blix
*Assistant Examiner*—Barry L. Kelmachter
*Attorney, Agent, or Firm*—Merchant, Gould, Smith, Edell, Welter & Schmidt

[57] ABSTRACT

An elongated body arranged to be mounted on a kite string for movements between an operator on the ground, and a flying kite on the far upper end of the kite string. A sail is mounted on the body for movements between an operative position wherein the same is wind propelled toward the flying kite, and an inoperative folded position wherein the plane of the sail is generally parallel to the kite string, permitting the body to descend the kite string by gravity. The sail is yieldingly urged toward its folded position, and releasable latch mechanism is provided to hold the sail in its operative position.

1 Claim, 3 Drawing Figures

KITE ACCESSORY TOY

This invention relates generally to kite flying and more specifically to accessory toys used in connection with kites. The sending of bits of paper or pasteboard along a kite string from the operator to the flying kite is well-known. When such traveling pieces reach the upper end of the string adjacent the kite, they remain there until the kite is brought to earth.

An important object of this invention is the provision of a kite accessory toy, which can be placed on a kite string for wind responsive movement upwardly to a flying kite; and which, upon arrival at the kite, will automatically descend to the operator on the ground.

SUMMARY OF THE INVENTION

The kite accessory toy of this invention includes an elongated body and support means on the body for suspending the same from a kite string in generally parallel relationship with the kite string. A sail extends generally transversely of the body. Means is provided mounting the sail on the body for movements between an operative position in a plane generally normal to the longitudinal dimension of the body, and a folded position in a plane generally parallel to the longitudinal dimension of the body. Yielding means urges the sail toward its folded position, and latch means releasably holds the sail in its operative position against bias of the yielding means.

DETAILED DESCRIPTION OF THE PREFERRED EMBODIMENT

Figure 1:
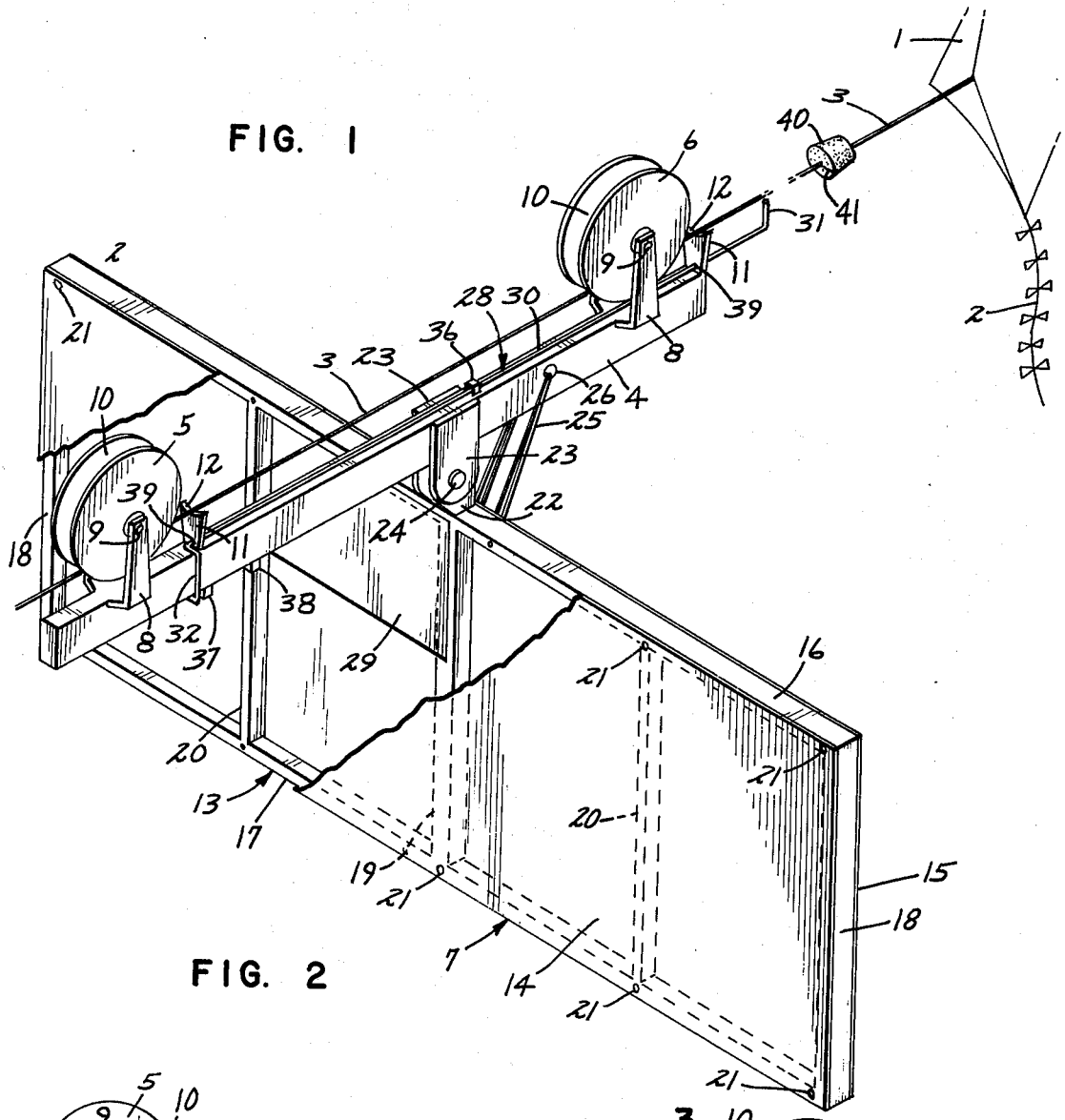
FIG. 1 is a view in perspective of the kite accessory toy of this invention as seen mounted on a kite string, some parts being broken away.

In FIG. 1, a conventional kite is shown fragmentarily and indicated at 1, the same being shown as provided with a tail 2 and secured to the outer or upper end of a kite string 3. The lower end of the kite string 3 is not shown, but may be assumed to be held by an operator on the ground.

The accessory toy of this invention comprises an elongated body 4, which may be made from any suitable material such as wood or molded plastics, a pair of trolley wheels 5 and 6 for suspending the body 4 on the kite string 3, and a rectangular sail 7. The trolley wheels 5 and 6 are each disposed adjacent an opposite end of the body 4 and are journaled in U-shaped brackets 8 that extend upwardly from opposite end portions of the body 4, the brackets 8 being provided with shafts 9 on which respective ones of the trolley wheels 5 rotate. As shown, the trolley wheels 5 and 6 are provided with relatively deep circumferential grooves 10 for reception of the kite string 3, the wheels 5 and 6 rolling over the kite string 3 so that the body 4 is disposed below the kite string 3 and generally parallel thereto. A pair of retainer members 11 project upwardly from the body 4, each adjacent a different one of the trolley wheels 5 and 6. The retainer members 11 have arcuate upper edge portions 12 that closely underlie the kite string 3 when the body 4 is suspended therefrom, to prevent accidental removal of the kite string 3 from the grooves 10 of the trolley wheels 5 and 6.

The sail 7 is preferably rectangular in shape and comprises a frame 13 and opposite side wall elements 14 and 15, the frame 13 including longitudinal frame members 16 and 17, end frame members 18, a central cross frame member 19, and intermediate cross frame members 20, the frame 13 being made from light weight wood or plastic material. The side wall elements 14 and 15 may be made from any suitable sheet material, and may be secured to opposite sides of the frame 13 by any suitable means. In the embodiment of the invention illustrated, the side wall elements 14 and 15 are secured to the frame 13 by commercially available staples or fasteners 21. As shown, the sail 7 extends transversely of the longitudinal dimension of the body 4, and is movable between an operative position shown in FIGS. 1 and 3 and by full lines in FIG. 2, wherein the plane of the sail 7 is generally normal to the longitudinal dimension of the body 4, and a folded position closely underlying one end portion of the body 4 and wherein the plane of the sail 7 is disposed generally parallel to the longitudinal dimension of the body 4. The sail 7 is formed to provide a central hinge element 22 that extends between a cooperating pair of laterally spaced hinge elements 23 that depend from the body 4, the hinge elements 22 and 23 being pivotally secured together by means of a hinge pin 24, the axis of which extends transversely with respect to the body 4. The sail 7 is yieldingly urged toward its folded position, illustrated by dotted lines in FIG. 2, by yielding means in the nature of an elastic band 25 that has an intermediate portion extending through an opening 26 through the body 4, the opposite ends of the elastic band 25 being secured to hook elements 27 that project outwardly from the sail 7, see particularly FIGS. 2 and 3.

Figure 2:
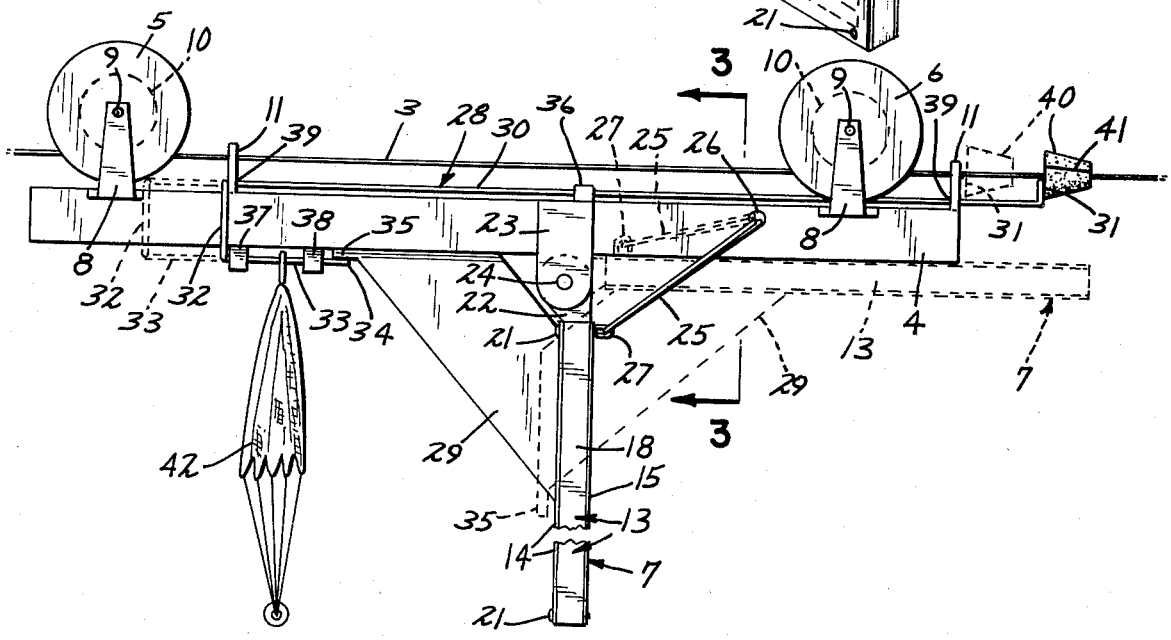
FIG. 2 is a view in side elevation, some parts being broken away.
Figure 3:
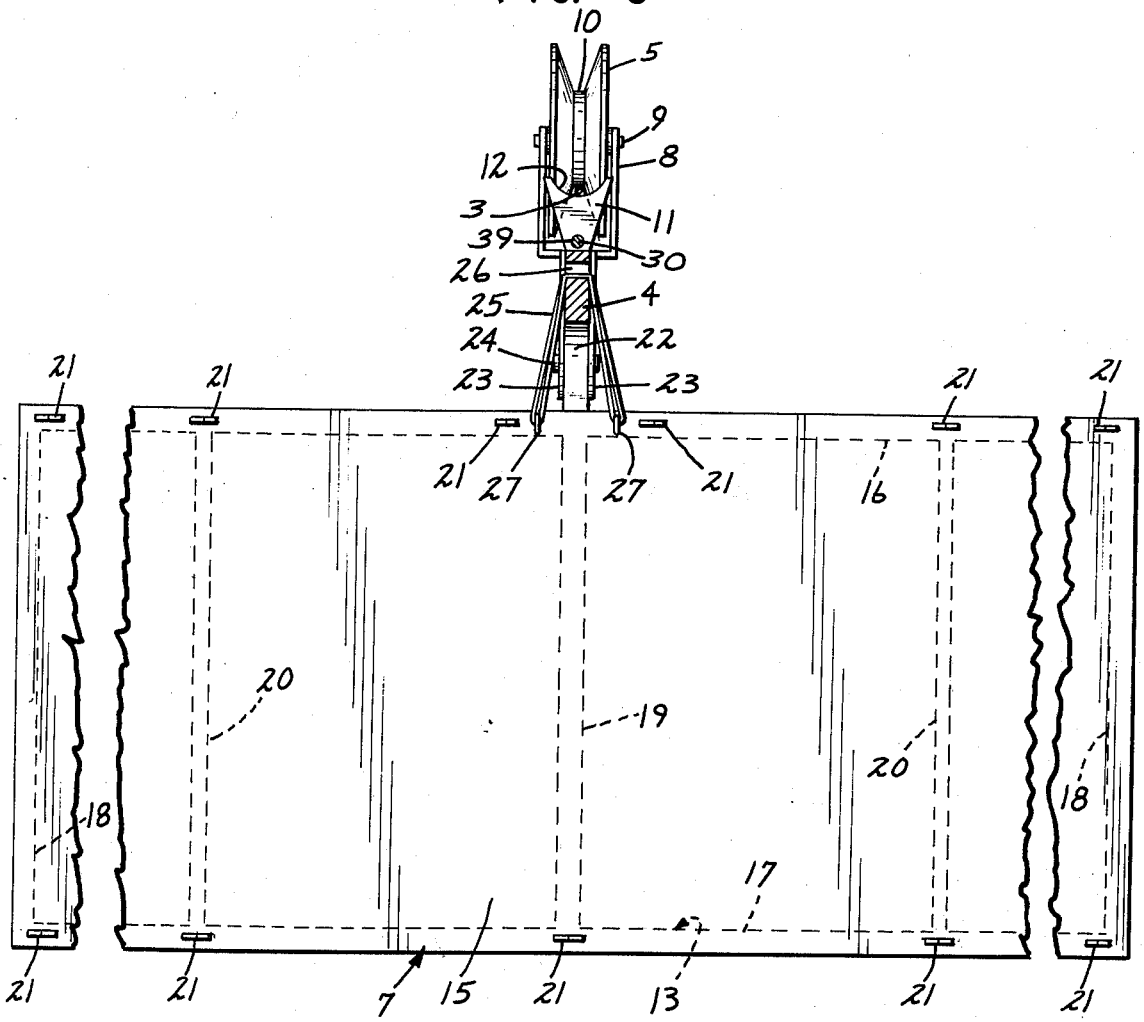
FIG. 3 is a view partly in elevation and partly in section, taken on the line 3—3 of FIG. 2.

The sail 7 is releasably held in its operative position, against bias of the elastic band 25, by latch means comprising a latch element 28, and a latch engaging member 29, secured to the sail 7 and projecting laterally outwardly from the side wall 14 thereof. The latch element 28 has an elongated portion 30 that overlies the body 4 and extends longitudinally thereof, an upturned end portion 31 that is normally disposed longitudinally outwardly with respect to the end of the body 4 adjacent the trolley wheel 6, an angular portion 32 that partially encompasses the body 4 between the trolley wheel 5 and its adjacent retainer member 11, and a lower end portion 33 that underlies the body 4 and the extreme end 34 of which is adapted to move into and out of latch engagement with a lip 35 on the latch engaging member 29, as shown in FIG. 2. The latch element 28 is mounted on the body 4 for movements longitudinally thereof by an upper bearing member 36, and a pair of lower members 37 and 38, the latter of which is disposed closely adjacent the lip 35 of the latch engaging member 29, the elongated portion 30 of the latch element 28 extending through openings 39 in the retainer members 11.

When the sail 7 is latched in its operative position, shown by full lines in the drawings, and the toy is mounted on the kite string 3, the wind which holds the kite aloft blows upon the sail 7, causing the toy to ascend along the string 3 toward the kite 1. For the purpose of unlatching the sail 7 when the toy nears the kite 1, I provide a stop element 40 that is mounted on the kite string 3 in close proximity to the kite 1 for abutting engagement with the upturned end portion 31 of the latch element 28. For the purpose of the present example, the stop element 40 is in the nature of a commercially available cork bottle stopper, the same being provided with a radial slit 41 for ease in applying the stop element 40 to the kite string 3. When the toy approaches the kite 1, the upturned end 31 of the latch element 28 impinges against the stop element 40, causing the latch element 28 to move in a direction to disengage the end 34 thereof from the lip 35 of the latch engaging member 29, as shown by dotted lines in FIG. 2. Upon such disengagement, the sail 7 is pivotally moved to its folded position shown by dotted lines in FIG. 2, so as to be disposed edgewise to the wind. When this occurs, the toy will descend along the kite string 3 under the action of gravity, returning to the operator on the ground. Upon arrival at the operators station, the sail 7 may be manually reset in its operative position, whereupon the toy will immediately proceed upwardly on the kite string 3 as hereinbefore described. As shown in FIG. 2, the toy may be used to transport other toy articles, such as a small weighted parachute 42, up to the kite 1 and release the same for independent movement to the ground. As shown in FIG. 2, the toy 42 can be suspended on the latch element portion 33 between the bearings 37 and 38, unlatching movement of the latch element 28 being sufficient to release the toy 42 when the upturned end portion 31 engages the stop element 40.

While I have shown and described a single embodiment of my accessory toy, it will be understood that the same is capable of modification, and that modification may be made without departure from the spirit and scope of the invention, as defined in the claim.

What is claimed is:

1. A kite accessory toy comprising:

a. an elongated body;

b. a pair of brackets each mounted on said body adjacent a different end of said body and projecting upwardly from said body;

c. a pair of trolley wheels each rotatably mounted in a different one of said brackets above said body, said trolley wheels having aligned circumferential radially outwardly opening grooves for reception of a kite string when the trolley wheels are placed in overlying engagement with said kite string;

d. a pair of retainer members, each retainer member projecting upwardly from said body adjacent a different one of said trolley wheels and disposed to closely underlie the kite string when said trolley wheels are in rolling engagement with the kite string, to retain the kite string in said trolley wheel grooves;

e. a sail extending generally transversely of said body;

f. a pair of cooperating pivotally connected hinge elements, one of said hinge elements being secured to said body and the other of said hinge elements being secured to said sail, said hinge elements hingedly mounting said sail to said body in underlying relationship to the body for swinging movements of the sail on a normally horizontal axis extending transversely of said body and between an operative position of said sail in a plane generally normal to the longitudinal dimension of the body and a folded position in a plane generally parallel to said longitudinal dimension;

g. yielding means urging said sail toward said folded position thereof;

h. an elongated latch element having a portion extending longitudinally of said body in overlying relationship to said body, said retainer members having openings therein supporting said latch element portion for sliding movements longitudinally of said body, said latch element having one end portion disposed longitudinally outwardly of one end of said body and in closely spaced relation to the kite string when said trolley wheels are mounted on the kite string, said latch element having an opposite end underlying said body;

i. a stop element adapted to be mounted on the kite string for abutting enngagement with said one end portion of the latch element;

j. and a stop member on said sail disposed to engage said body to limit swinging movement of said sail toward its operative position, said stop member having a lip portion engaged by said opposite end of the latch element to releasably hold the sail in said operative position thereof.

* * * * *